US009972227B2

(12) United States Patent
Evans

(10) Patent No.: US 9,972,227 B2
(45) Date of Patent: May 15, 2018

(54) WIND-DRIVEN DISPLAY DEVICE

(71) Applicant: Steven Gray Evans, Wilmington, IL (US)

(72) Inventor: Steven Gray Evans, Wilmington, IL (US)

( * ) Notice: Subject to any disclaimer, the term of this patent is extended or adjusted under 35 U.S.C. 154(b) by 0 days. days.

(21) Appl. No.: 14/541,669

(22) Filed: Nov. 14, 2014

(65) Prior Publication Data

US 2015/0128463 A1 May 14, 2015

Related U.S. Application Data

(60) Provisional application No. 61/904,209, filed on Nov. 14, 2013.

(51) Int. Cl.

| | |
|---|---|
| ***G09F 19/00*** | (2006.01) |
| ***G09F 7/22*** | (2006.01) |
| ***G09F 19/12*** | (2006.01) |

(52) U.S. Cl.

CPC ..... *G09F 7/22* (2013.01); *G09F 19/12* (2013.01)

(58) Field of Classification Search

USPC ..... 40/440, 479; 446/217, 218, 236

See application file for complete search history.

(56) References Cited

U.S. PATENT DOCUMENTS

| | | | | |
|---|---|---|---|---|
| 1,906,668 | A * | 5/1933 | Valk | 40/440 |
| 2,985,976 | A * | 5/1961 | Parker | 40/440 |
| 3,374,763 | A * | 3/1968 | Browning | 359/525 |
| 3,747,263 | A * | 7/1973 | Grossberg | A63H 33/40 40/479 |
| 6,398,615 | B1 * | 6/2002 | Wu et al. | 446/217 |
| 7,788,835 | B2 * | 9/2010 | Venn | 40/604 |

* cited by examiner

*Primary Examiner* — Joanne Silbermann

(74) *Attorney, Agent, or Firm* — Dunlap Bennett & Ludwig PLLC

(57) ABSTRACT

A wind-driven spinner is provided. The wind-driven spinner embodies a rotatable display that enables customizable, holographic effects to capture the eye, while also providing adjustable stability and wind capturing controls. The wind-driven spinner may include a plurality of panel assemblies rotatably mounted to an axis shaft by means of two hub bearings. Each panel assembly may be paraboloid shaped so as to provide a leading edge and a trailing edge. Relative to the axis shaft, the leading edge of each panel assembly has a radial outer diameter greater than the radial outer diameter of its trailing edge and an adjacent panel assembly so as to provide at least one, adjustable wind-driven capture profile. Each panel assembly may include a customizable design sheet for providing graphic display area and holographic fabric.

9 Claims, 4 Drawing Sheets

WIND-DRIVEN DISPLAY DEVICE

CROSS-REFERENCE TO RELATED APPLICATION

This application claims the benefit of priority of U.S. provisional application No. 61/904,209, filed 14 Nov. 2013, the contents of which are herein incorporated by reference.

BACKGROUND OF THE INVENTION

The present invention relates to a display device and, more particularly, to a wind-driven rotating display.

Currently, a number of devices provide a wind-driven rotatable display of graphics. However, there is no such display device that attracts the eye with customizable designs and holographic effects, while also providing adjustable stability and wind capturing controls.

As can be seen, there is a need for a wind-driven rotatable display that enables customizable, holographic effects to capture the eye, while also providing adjustable stability and wind capturing controls.

SUMMARY OF THE INVENTION

In one aspect of the present invention, a wind-driven spinner comprises an axis shaft; two hub bearings, each hub bearing rotatably mounted at two mounting points, wherein each mounting point is near opposing ends of the axis shaft; and a plurality of panel assemblies, wherein each panel assembly extends between and is removably mounted to each hub bearing, wherein each panel assembly comprises a design sheet spanning between a leading edge and a trailing edge, wherein a distance from the leading edge to the axis shaft is longer than a distance from the trailing edge to the axis shaft, forming a capture profile between adjacent panel assemblies.

In yet another aspect of the present invention, a wind-driven spinner comprises: an axis shaft, wherein the axis shaft provides a threaded end on each opposing end thereof, wherein each threaded end is configured at least for adjusting the disposition of an adjacent mounting point on the axis shaft; two hub bearings, each hub bearing rotatably mounted to the adjacent mounting point, and wherein each hub bearing provides a plurality of panel rod slots; and a plurality of panel assemblies, wherein each panel assembly extends between and is removably mounted to each hub bearing, wherein each panel assembly comprises a design sheet spanning between a leading edge and a trailing edge, wherein a distance from the leading edge to the axis shaft is longer than a distance from the trailing edge to the axis shaft, forming a capture profile between adjacent panel assemblies, wherein each leading edge and each trailing edge provides a respective panel rod configured to removably attach to the plurality of panel rod slots, wherein at least one design sheet provides a holographic fabric or a graphic display area, and wherein each design sheet further provides a heat lamented surface.

These and other features, aspects and advantages of the present invention will become better understood with reference to the following drawings, description and claims.

DETAILED DESCRIPTION OF THE INVENTION

Figure 1:
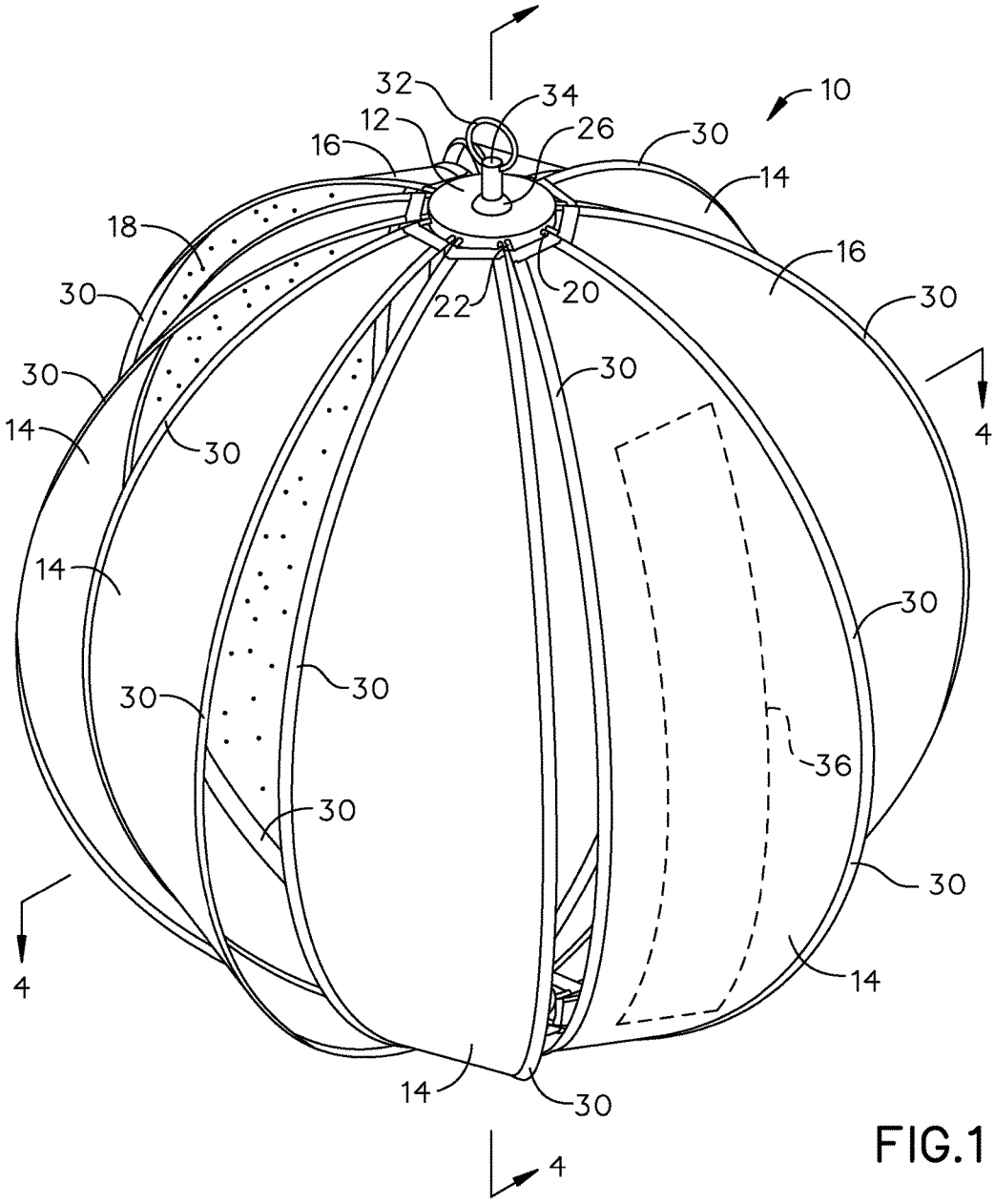
FIG. 1 is a perspective view of an exemplary embodiment of the present invention.
Figure 2:
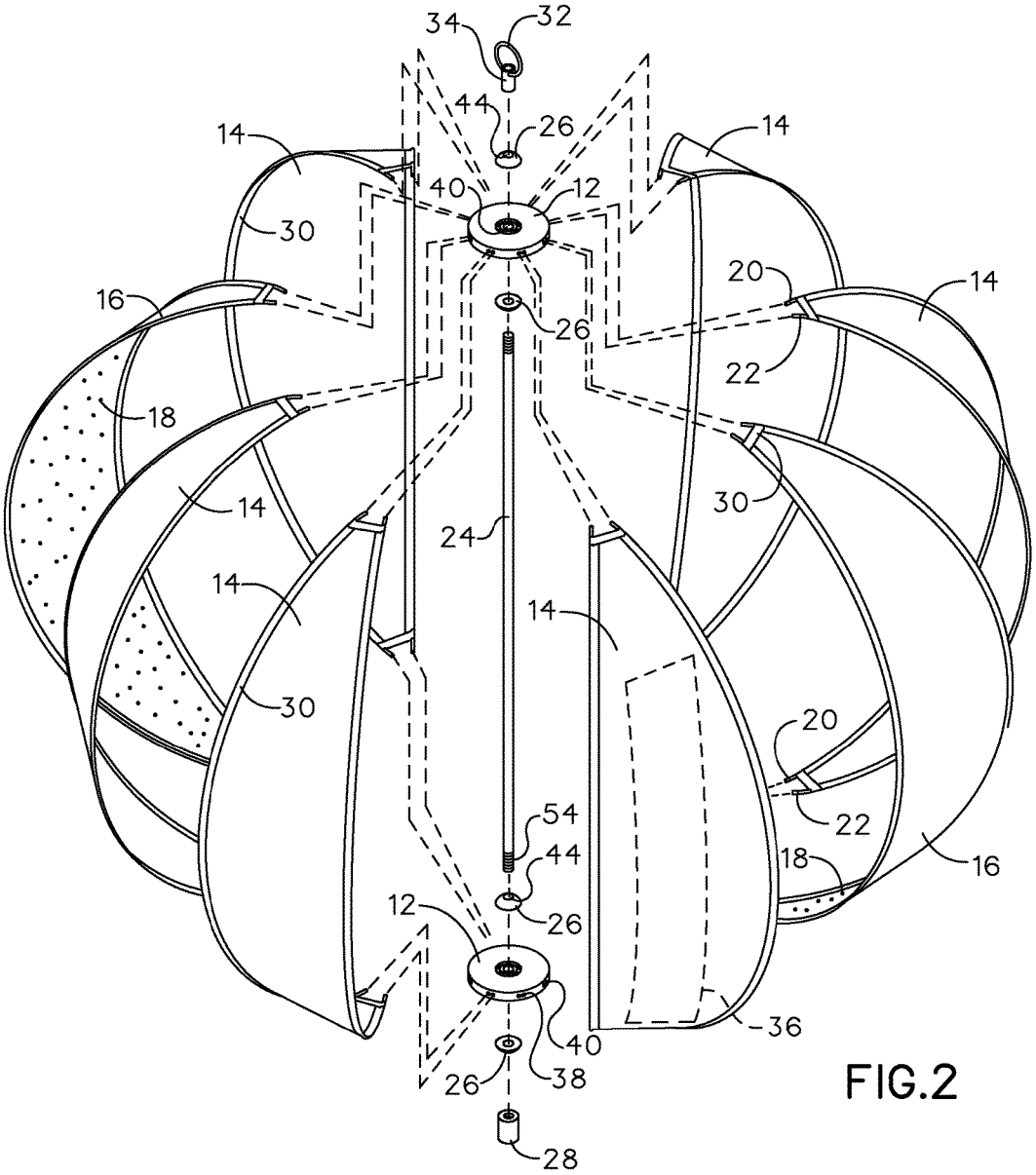
FIG. 2 is an exploded view of an exemplary embodiment of the present invention.

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

Broadly, an embodiment of the present invention provides a wind-driven spinner that embodies a rotatable display that enables customizable, holographic effects to capture the eye, while also providing adjustable stability and wind capturing controls. The wind-driven spinner may include a plurality of panel assemblies rotatably mounted to an axis shaft by means of two hub bearings. Each panel assembly may be paraboloid shaped so as to provide a leading edge and a trailing edge. Relative to the axis shaft, the leading edge of each panel assembly has a radial outer diameter greater than the radial outer diameter of its trailing edge and an adjacent panel assembly so as to provide at least one, adjustable wind-driven capture profile. Each panel assembly may include a customizable design sheet for providing graphic display area and holographic fabric.

Referring to FIGS. 1 through 7, the present invention may provide a customizable, wind-driven spinner 10. The wind-driven spinner 10 may include a plurality of panel assemblies 14 rotatably mounted to an axis shaft 24 by means of two hub bearings 12. Each hub bearing 12 may be rotatably mounted near the opposing ends of the axis shaft 24. Each panel assembly 14 may extend from one hub bearing 12 to the other hub bearing 12. The wind-driven spinner 10 may be configured in any shape or size so long as the wind-driven spinner 10 functions in accordance with the present invention as described herein.

Figure 4:
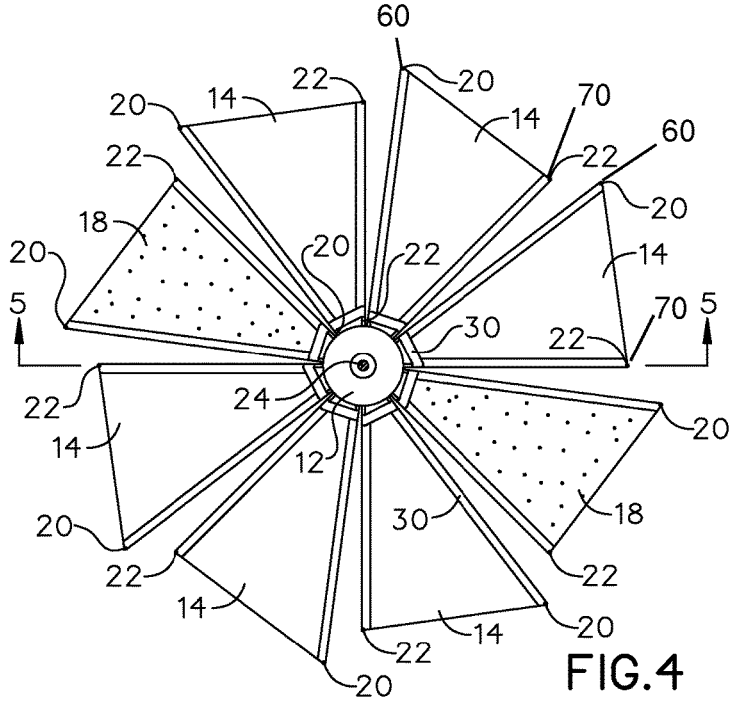
FIG. 4 is a section view of an exemplary embodiment of the present invention, taken along line 4-4 in FIG. 1.
Figure 5:
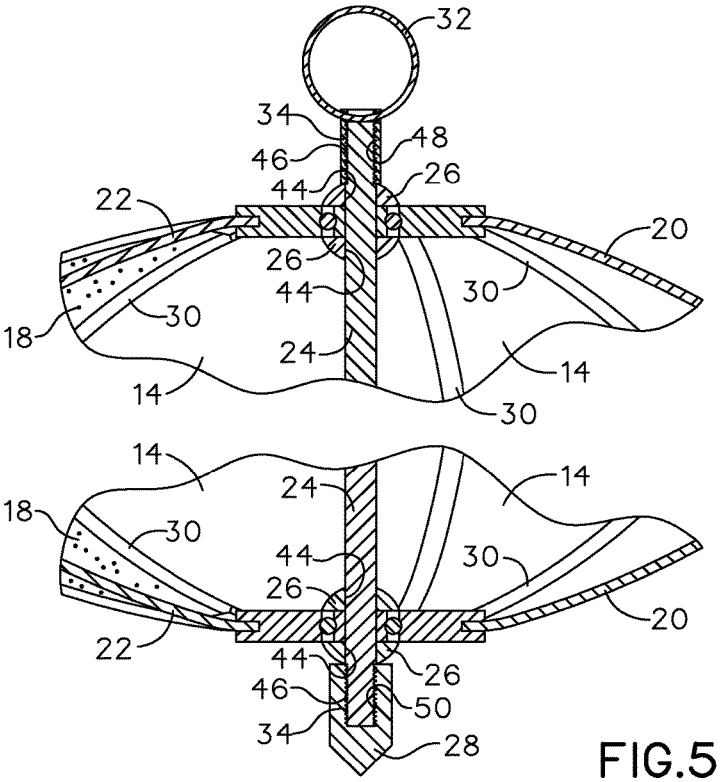
FIG. 5 is a section view of an exemplary embodiment of the present invention; taken along line 5-5 in FIG. 4.
Figure 6:
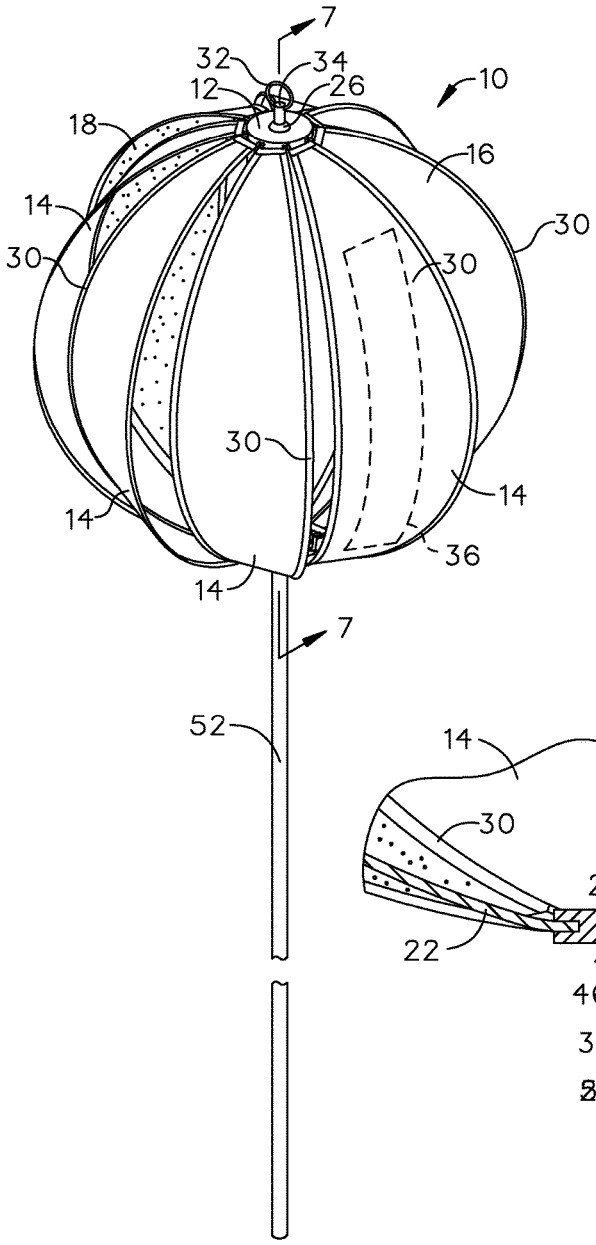
FIG. 6 is a perspective view of an exemplary embodiment of the present invention.
Figure 7:
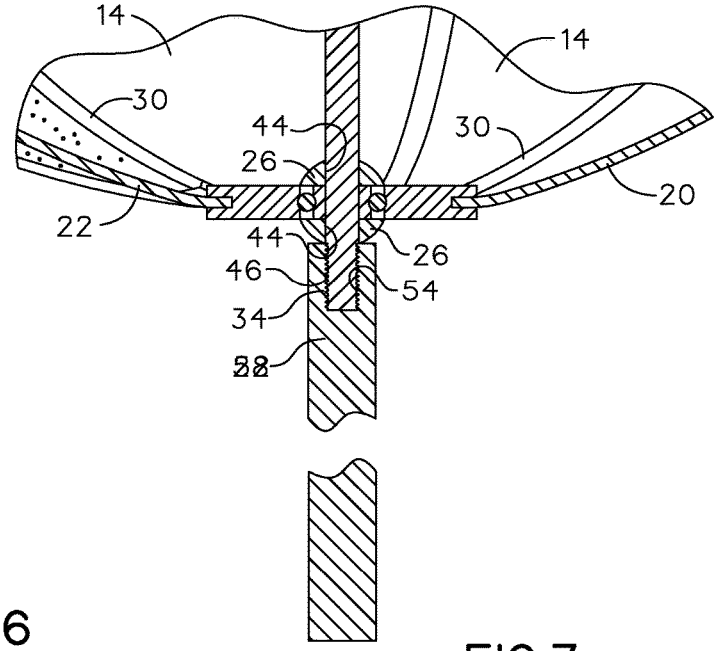
FIG. 7 is a section view of an exemplary embodiment of the present invention, taken along line 6-6 in FIG. 5.

Each panel assembly 14 may be paraboloid shaped so as to provide a leading edge 60 and a trailing edge 70. Relative to the axis shaft 24, the leading edge 60 of each panel assembly 14 has a radial outer diameter greater than the radial outer diameter of its trailing edge 70 and an adjacent panel assembly 14, as illustrated in FIG. 4. The distance associated with the difference in radial outer diameter between adjacent leading and tailing edges 60, 70 may define a capture profile. The plurality of panel assemblies 14 may provide at least one capture profile. At a certain point, depending on the wind speed, the force of the wind along at least one capture profile produces sufficient torque to overcome the friction in the system, carrying the corresponding panel assemblies 14 with them, causing the two hub bearings 12 to rotate about the axis shaft 24, thereby providing a wind-driven device spinning about the axis shaft 24.

Figure 3:
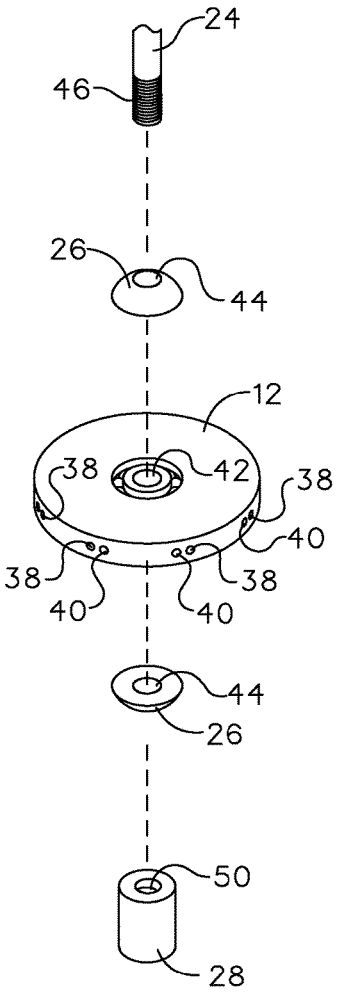
FIG. 3 is a detail exploded view of an exemplary embodiment of the present invention.

Each panel assembly 14 may include a design sheet 16 made of flexible or rigid material and having a leading pocket 30 and a trailing pocket 30. Each pocket 30 may define a cavity for slidably receiving a leading and a trailing panel rod 20, 22, respectively. The opposing ends of the panel rods 20, 22 may be adapted to detachable mount to a portion of the two hub bearings 12 so that when received by the leading pocket 30 and the trailing pocket 30, the panel rods 20, 22 urge each panel assembly 14 to form their desired paraboloid shape. Moreover, the shape of each panel assembly 14 may be reinforced with a heat lamented surface 18 provided on a portion of each design sheet 16. The detachable mounting of the panel rods 20, 22 may be facilitated by rod slots 38, 40 respectively spaced along the portion of the two hub bearings 12, as illustrated in FIG. 3. The portion of the two hub bearings 12 may be its periphery.

The length of each panel rod 20, 22 may be adapted to adjust the radial outer diameters of one or both of the leading and tailing edges 60, 70, and as a result the size and shape of the at least one capture profile. Similarly, the disposition of the two hub bearings 12 along the axis shaft 24 may make the at least one capture profile adjustable.

The design sheet 16 can be interchangeable as a function of the detachable mounting of the panel rods 20, 22. Similarly, the design sheets 16 may provide a graphic display area 36, a holographic fabric and the like so as to make the spinner 10 customizable. Each graphic display area 16 may enhance the customizability of the wind-driven spinner 10, whereby the graphic display area 16 conveys any desired message, decoration or sign a user wishes to display. In certain embodiments, every other design sheet 16 may provide holographic fabric so that as the wind-driven spinner 10 twirls a holographic effect is generated thereon.

Each hub bearings 12 may provide a bearing slot 42 for slidably receiving the axis shaft 24 so as to facilitating the rotatable mounting therein. The axis shaft 24 may provide threaded ends 46 that protrude through each bearing slot 42 receiving the axis shaft 24. Each threaded end 46 may mate to a stake 52 with cooperating stake threading 54, a mass 28 with cooperating mass threading 50, or a cap 34 with cooperating cap threading 48. The disposition of the two hub bearings 12 along the axis shaft by, in certain embodiment, the length of each threaded end 46 and the mating of cooperating threading may makes the at least one capture profile adjustable.

The cap 34 may provided a hanging ring 32 adapted to hang the wind-driven spinner 10 from a support, such as a hook. Between the cap 34 and the adjacent hub bearing 12 may be a bushing 26 with a cooperating shaft aperture 44. The stake 54 may be adapted to support the wind-driven spinner 10 in the ground or other supporting surface so as to become a ground display.

The mass 28 may be adapted to add sufficient weight for stabilizing the twirling wind-driven spinner 10. A function of the cooperating mass threading 50 is to provide a means of adjusting the mass 28 when stabilizing the spinner 10, for example during various wind conditions.

A method of using the present invention may be as follows. The wind-driven spinner 10 disclosed above may be provided. A user may removably attach the stake 54 to one of the threaded ends 46 so as to create a ground or hand-held display. Alternatively, the user may removably attach the cap 34 and hanging ring 32 so as to create a hanging display. When used as a hanging display, the user may choose a weight of the mass 28 sufficient to properly stabilize the wind-driven spinner 10 given the current and/or projected wind conditions.

The user may interchange the design sheet 16 of at least one panel assembly 14, to provide a new color, a new graphic display area 16 and/or a new holographic fabric so as to continually customize the display they currently desire.

It should be understood, of course, that the foregoing relates to exemplary embodiments of the invention and that modifications may be made without departing from the spirit and scope of the invention as set forth in the following claims.

What is claimed is:

1. A wind-driven spinner comprising:

an axis shaft comprising a top end and a bottom end;

a top hub bearing rotatably mounted near the top end of the axis shaft and a bottom hub bearing rotatably mounted near the bottom end of the axis shaft; and a plurality of panel assemblies, wherein each panel assembly comprises:

a leading panel rod comprising a top end releasably secured to the top hub bearing and a bottom end releasably secured to the bottom hub bearing, the leading panel rod defining a leading edge comprising a first bend; and a trailing panel rod comprising a top end releasably secured to the top hub bearing and a bottom end releasably secured to the bottom hub bearing, the trailing panel rod defining a trailing edge comprising a second bend;

a design sheet comprising a leading pocket and a trailing pocket, wherein the leading panel rod is disposed within the leading pocket and the trailing panel rod is disposed within the trailing pocket such that the design sheet spans between the leading panel rod and the trailing panel rod, wherein the second bend of the trailing edge comprises a greater radius of curvature than the first bend of the leading edge, thereby defining a capture profile in the design sheet.

2. The wind-driven spinner of claim 1, wherein each of the top hub bearing and the bottom hub bearing comprise a plurality of rod slots, wherein the top ends and the bottom ends of the leading panel rods and the trailing panel rods fit within a respective rod slot of the plurality of rod slots.

3. The wind-driven spinner of claim 1, wherein at least one design sheet further provides a holographic fabric or a graphic display area.

4. The wind-driven spinner of claim 1, wherein the top end and the bottom end of the axis shaft are threaded.

5. The wind-driven spinner of claim 4, further comprising two threaded devices, each threaded device having a first end providing a receiving cavity comprising internal threads, wherein the receiving cavity of each threaded device mechanically fastens to a respective end of the top end and the bottom end of the axis shaft.

6. The wind-driven spinner of claim 5, wherein one of the two threaded devices is a shaft.

7. The wind-driven spinner of claim 5, wherein one of the two threaded devices is a cap.

8. The wind-driven spinner of claim 7, wherein the cap provides a hanging ring.

9. The wind-driven spinner of claim 7, wherein another of the two threaded devices is a mass.

* * * * *